US008561988B1

(12) United States Patent
Mandel et al.

(10) Patent No.: US 8,561,988 B1
(45) Date of Patent: Oct. 22, 2013

(54) MEDIA HOLD-DOWN FOR PRINTING SYSTEM

(75) Inventors: Barry P. Mandel, Fairport, NY (US); Ming Yang, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/532,499

(22) Filed: Jun. 25, 2012

(51) Int. Cl.
*B65H 5/02* (2006.01)
*B65H 5/04* (2006.01)

(52) U.S. Cl.
USPC ..... 271/276; 271/196

(58) Field of Classification Search
USPC ..... 271/276, 196; 347/104; 101/232, 279
See application file for complete search history.

(56) References Cited

U.S. PATENT DOCUMENTS 5,376,954 A * 12/1994 Kerr ..... 346/138
5,971,393 A * 10/1999 Vernackt ..... 271/276

* cited by examiner

*Primary Examiner* — David H Bollinger

(57) ABSTRACT

A media hold down apparatus including a media transport including a transport surface having a plurality of vacuum openings formed therein in fluid communication with a vacuum source. The media transport is adapted to move substrate media in a process direction past a print zone. The transport surface includes a first recess extending in a cross-process direction along a portion of a width of a first sheet of substrate media transport. The recess is disposed on the media transport such that the recess lies beneath one of a leading or trailing edge portion of the first sheet of substrate media. The recess is in communication with the vacuum source, wherein the vacuum urges the one of a leading or trailing edge portion toward the recess on to the transport surface.

18 Claims, 9 Drawing Sheets

MEDIA HOLD-DOWN FOR PRINTING SYSTEM

TECHNICAL FIELD

This disclosure relates to an apparatus for securing a sheet of substrate media during transport, and more particularly to an apparatus and system for securely holding a sheet including the leading and trailing edges during transport through a printing system.

BACKGROUND

Printing on sheets of substrate media by direct marking is a rapidly expanding marking technology due to low run-costs and overall simplicity. Direct marking printing includes printing systems using inkjet technology where one or more print heads are located proximate to the sheet surface. As resolutions improve, many believe that direct marking will make inroads relative to markets where xerographic systems currently dominate. Three challenges with direct to paper marking systems include; achieving good marking quality of the media, holding the media away from the print-heads to prevent burnishing or clogging of the print head nozzles, and achieving sufficiently high resolution with a single pass at low costs.

In such systems it is important to consistently hold the sheets flat as they pass by the print heads. If the portion of the sheet onto which an image is to be printed is not flat, the image quality will suffer. Moreover, if the edges or any part of the sheet project upwardly, they can engage the print heads causing damage. In order to hold the sheet flat, media vacuum hold-down drums or plates have been used. Such drums/plates typically enable good marking quality and enable multi-pass printing which requires fewer print heads and saves cost.

However, a drum/plate increases the challenge of holding the media away from the print heads with upcurled sheet leading and trailing edges becoming especially challenging. As shown in FIG. 1, in prior art systems with vacuum drum 4 having a smooth drum surface 6, the bending moment exerted by the vacuum on the sheet 8 becomes very small as you get closer to the edge of the media 10 (and eventually becomes zero). This makes it very difficult to hold the edge tightly to the drum and a gap 12 can exist.

Accordingly, it would be desirable to provide a media hold-down apparatus and system which improves hold down performance of the leading and trailing edges of substrate media.

SUMMARY

According to aspects described herein, there is disclosed a media hold down apparatus including a media transport including a transport surface having a plurality of vacuum openings formed therein in fluid communication with a vacuum source. The media transport is adapted to move substrate media in a process direction past a print zone. The transport surface includes a first recess extending in a cross-process direction along a portion of a width of a first sheet of substrate media transport. The recess is disposed on the media transport such that the recess lies beneath a leading edge portion of the first sheet of substrate media. The recess is in communication with the vacuum source, wherein the vacuum urges the leading edge toward the recess on to the transport surface.

According to other aspects described herein, there is provided a direct marking system including a media transport including a transport surface having a plurality of openings formed therein in fluid communication with a vacuum source to constrain media through the application of a vacuum force. The outer surface includes a first recess extending in a cross-process direction along a portion of a width of the media transport. The first recess is disposed on the media transport such that it lies beneath a leading edge portion of the media, the first recess being in communication with the vacuum source, wherein the leading edge is pulled down by the vacuum toward the first recess on to the transport surface. An image marking system marks the media when passing through a print zone, wherein the media transport moves the media in a process direction past the image marking system.

According to still other aspects described herein, there is provided a method of holding and transporting a sheet of media including delivering a sheet of substrate media having a leading edge to a media transport. The media transport includes a transport surface having a plurality of vacuum openings formed therein in fluid communication with a vacuum source. The media transport is adapted to move substrate media in a process direction past a print zone. The outer surface including a first recess extending in a cross-process direction along a portion of a width of a first sheet of substrate media transport. The recess is in operative communication with the vacuum source. The method further including positioning the leading end of the media at least partially over the first recess; applying a vacuum through the transport surface to draw the sheet of media toward the transport surface; and applying a vacuum through the recess to draw the leading edge toward the transport surface.

DETAILED DESCRIPTION

Describing now in further detail these exemplary embodiments with reference to the Figures, as described above the media hold down is typically used in a select location or locations of the paper path or paths of various conventional media handling assemblies. Thus, only a portion of an exemplary media handling assembly path is illustrated herein.

As used herein, a "printer," "printing assembly" or "printing system" refers to one or more devices used to generate "printouts" or a print outputting function, which refers to the reproduction of information on "substrate media" for any purpose. A "printer," "printing assembly" or "printing system" as used herein encompasses any apparatus, such as a digital copier, bookmaking machine, facsimile machine, multi-function machine, etc. which performs a print outputting function.

As used herein, "substrate media" refers to, for example, paper, transparencies, parchment, film, fabric, plastic, photofinishing papers or other coated or non-coated substrates on which information can be reproduced, preferably in the form of a sheet or web. While specific reference herein is made to a sheet or paper, it should be understood that any substrate media in the form of a sheet amounts to a reasonable equivalent thereto. Also, the "leading edge" of a substrate media refers to an edge of the sheet that is furthest downstream in the process direction. The "trail edge" or trailing edge of the substrate media refers to an edge of the sheet that is furthest upstream in the process direction, and the lateral edge or edges refer to one or more of the opposed side edges of the sheet, extending substantially in the process direction.

As used herein, the terms "process" and "process direction" refer to a process of moving, transporting and/or handling a substrate media. The process direction is a flow path (also described as a transport path) the substrate media moves in during the process. A "cross-process direction" is perpendicular to the process direction and generally extends parallel to the width of the substrate media.

As used herein, the term "media transport" refers to an apparatus for transporting a sheet of media in a printing system. A media transport can be in the form of a rotating drum or translating sled. The media transport may have a transport surface upon which the media is supported.

As used herein, the term "image marking system" refers to an apparatus for imparting an image on to substrate media.

As used herein, the term "media hold-down" refers to a device for securing a sheet of substrate media to a transport surface of the media transport.

As used herein, the term "recess" refers to a depression, slot, indentation, gap, or the like which forms an interruption in a surface.

Figure 2:
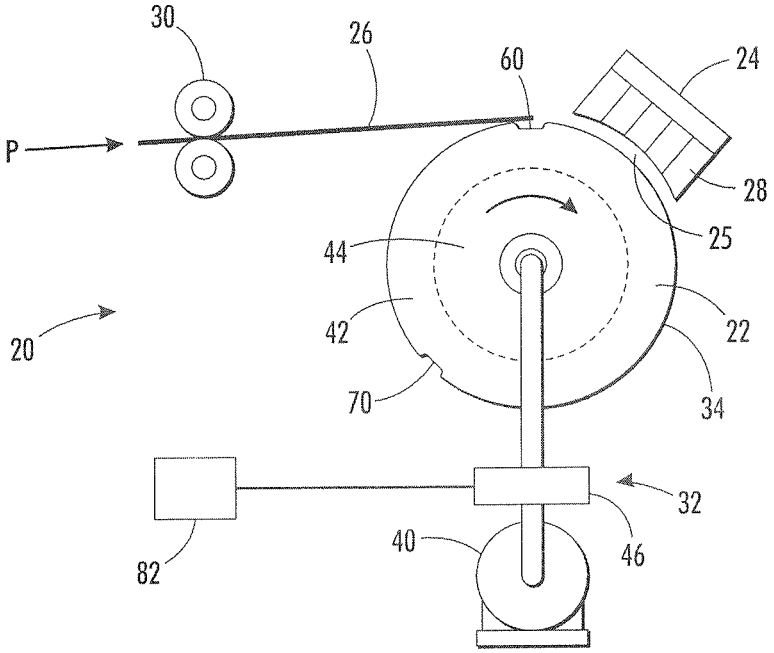
FIG. 2 is a media transport of the present disclosure showing a sheet of media being secured thereto.

With reference to FIG. 2, a printing system 20 including a media transport 22 and image marking system 24 is shown. The media transport 22 moves a sheet of substrate media 26 in a process direction past a print zone 25 of the image marking system 24. The image marking system 24 may include one or more print heads 28 which permit for direct marking of the media 26 to form an image thereon. The media transport 22 may receive the media from a pair of upstream transfer nips 30 wherein the media 26 is captured by the media transport 22 as it is released from the transfer nips.

The media transport 22 includes a media hold-down 32 for securing a sheet of media 26 to a transport surface 34 of the media transport. The media hold-down 32 applies a hold-down force that is selectively engagable to allow the media 26 to be selectively secured and released from the media transport. The media hold-down may include a vacuum system 36 wherein the transport surface 34 includes a plurality of openings 38 (FIG. 5) formed therein which are in fluid communication with a vacuum source 40. In one embodiment, the media transport may be in the form of a vacuum drum 42 having an inner plenum 44 region operably connected to the vacuum source 40. The vacuum plenum 44 communicates with the surface openings 38 may be arranged such that various sections of transport surface 34 may be selectively and independently subjected to a vacuum. It is within the contemplation of the present invention that the media hold-down 32 may include other known manners of securing a sheet to a transport surface, including, for example, electrostatic hold-down force or a combination of vacuum and electrostatic force.

The vacuum flow may be regulated by a controller 46 which generates a signal to turn the vacuum on and off at predetermined times. For example, when the media 26 is first received by the media transport 22, the vacuum may be applied so that the media is drawn to the transport surface thereby allowing rotary motion of the vacuum drum to transport the media sheet past the print heads 28. After the media has been marked with an image, the vacuum may be removed so that the media can be removed from the media transport and travel further down the transport path in the process direction P. A positive pressure may be applied to the media to help separate it from the transport surface. The controller 46 may include one or more vacuum control valves and a control circuit for operating the valves.

Figure 3:
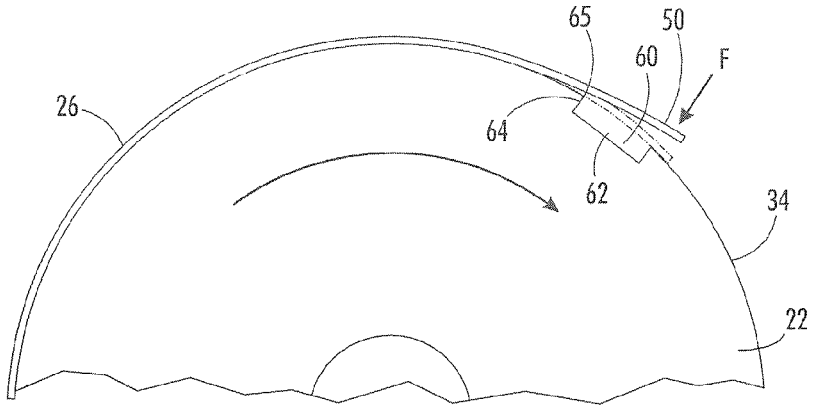
FIG. 3 is a side view of a portion of a media transport vacuum drum having a recess on an outer surface with a sheet of media thereon.
Figure 4:
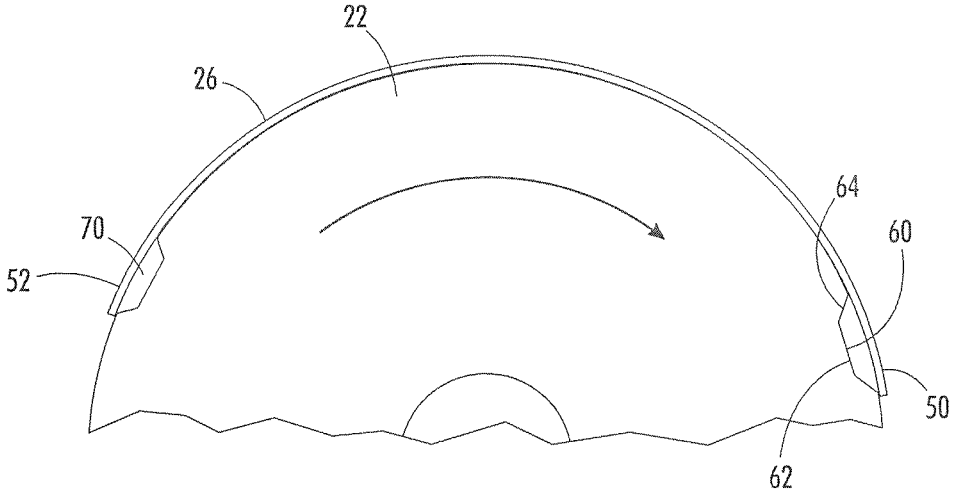
FIG. 4 is a side view of an alternative embodiment of a media transport vacuum drum having a plurality of recesses on an outer surface with a sheet of media thereon.
Figure 5:
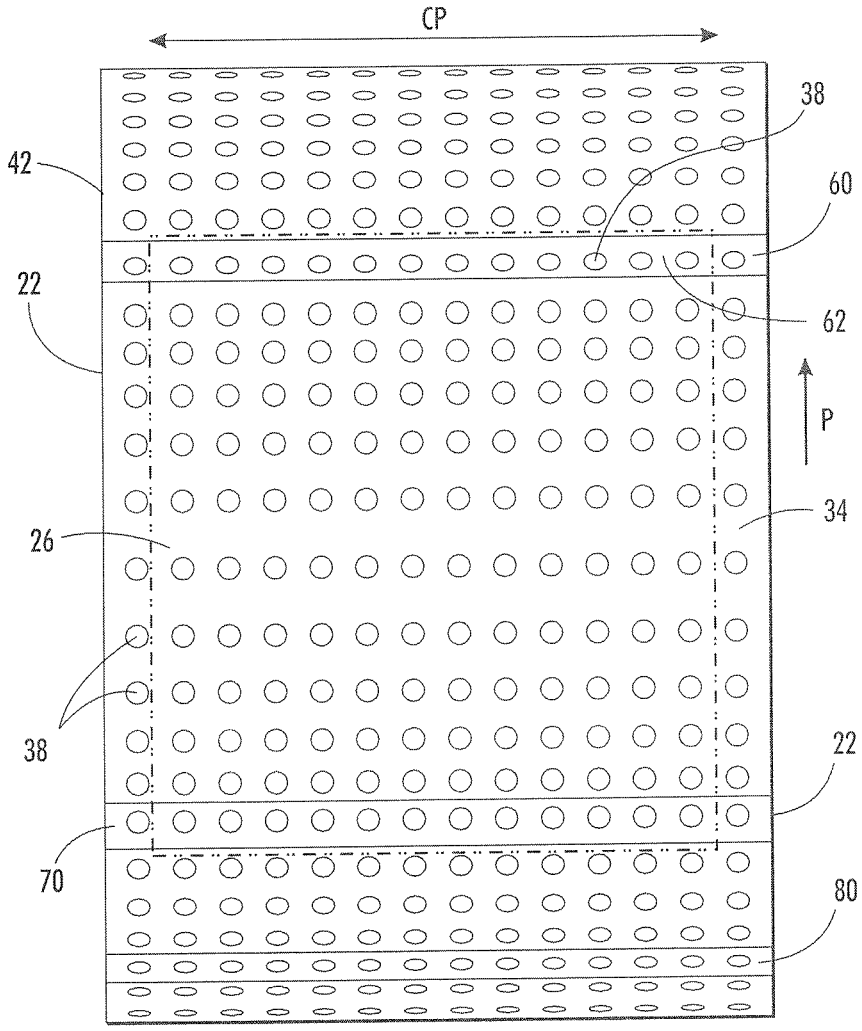
FIG. 5 is a top view of a media transport outer surface

With reference to FIGS. 3, 4 and 5 when a hold-down force is applied to the media 26, the media tends to conform to the transport surface 34. It is desirable that the entire sheet of media lies flat against the transport surface both to avoid media engagement with the print heads 28, and to keep a uniform distance between the media and the print head which enables a uniformly high image quality across the media. However, the media edges, such as the leading 50 and trailing edges 52, may be more difficult to hold down. This is especially true if the edges have an upcurl. In order to assist in holding the edges flat against the transport surface 34, the transport surface may include a first recess 60 extending along a cross-process direction CP along with the width of the vacuum drum 42. The first recess 60 may be in the form of a slot having a base 62 joined by upwardly extending side walls 64 which engage the top portion of the transport surface. The engagement of the wall and the top portion of the transport surface form a recess edge 65. In one embodiment, shown in FIG. 3, the oppose side walls may engage the top portion of the transport surface at generally a right angle, such that the recess 60 has a generally rectangular cross-sectional profile. Another embodiment show in FIG. 4, it is contemplated that the side walls 64 may form an obtuse angle with the transport surface with the wall extend in a more gradual sloping manner toward the outer transport surface. The first recess may have a generally rectangular in shape; however, it is also contemplated that the recess could be formed in different shapes. These recesses move the bending point of the media farther away from the leading edge or trailing edge of the sheet, which enables the vacuum force to more effectively deflect the leading or trailing edge of the sheet toward the transport surface 34.

The first recess 60 may be located on the media transport at a location which corresponds to the media leading edge 50. The recess base 62 may include a plurality of vacuum openings 38 such that vacuum may be generated over the recess region of the media transport. The first recess 60 may have a length extending in the cross-process direction in an amount equal or greater than the width of the media. Accordingly, the recess 60 extends over the entire width of sheet of media.

With reference to FIG. 4, the media transport 22 may include a second recess 70 spaced a distance from the first recess 60. The second recess 70 is preferably formed in a manner similar to the first recess 60. The distance between the first and second recess traveling along the transport surface is dependent on the length of the sheet of media which the media transport is intended to secure and transport. Accordingly, the second recess 70 may be disposed at a location on the media transport surface such that it is aligned with the sheet of media trailing edge 52.

Figure 3A:
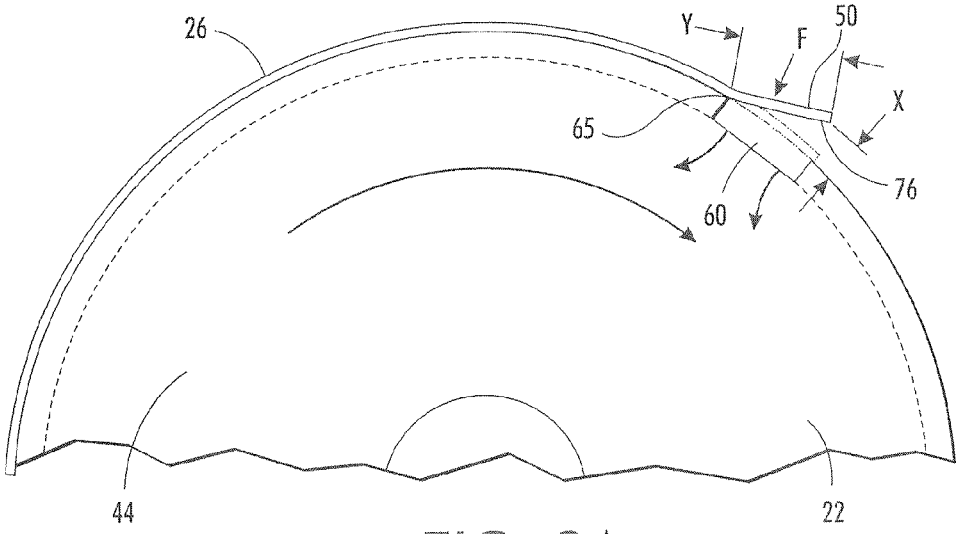
FIG. 3A is a detailed side view of a media edge disposed above a recess.

With reference to FIGS. 3 and 3A, when a sheet of media 26 is delivered to the media transport, the leading edge 50 overhangs the first recess 60. In situations where the leading edge 50 has an upward curl, this leading edge will be spaced a distance X above the base of the recess. When a vacuum is applied, the overhanging cantilevered sheet edge portion 76 having a length Y creates a moment arm which is rotated about the recess edge 65 by the vacuum force F. The recess edge acts like a fulcrum or bending point with the media cantilevered portion providing the moment arm. The cantilevered edge portion will keep moving downward unimpeded by the transport surface since the media deflects into the recess. In addition, as the media portion 75 is urged down to the transport surface 34, the length Y of the moment arm remains substantially the same. Therefore, the torque exited by the vacuum force does not diminish as the media edge portion 76 moves to the transport surface 34. This allows for a significant torque to urge the leading edge downward toward flat against the transport surface, FIG. 4. The mechanism acting on the sheet would be the same for the second recess 70 which is positioned adjacent to the media trailing edge 52.

In one embodiment, the recess may be positioned so that the end of the media would fall within the recess. The recess may be relatively shallow in the range of 50-200 microns in depth and between 10 and 50 millimeters in width in the process direction. The size of the recess may depend on the weight of the media with the larger recesses of 200 microns or greater being used with heavier weight media. The recess depth would minimize image quality problems, but permit a moment to be created to assist in deflecting leading edge of the media down toward the transport surface. Since the recess is relatively shallow and close to the end of the sheet, image defects due to changes and print head gap are not significant. In another embodiment, the recess may be positioned such that the media would completely span the width of the recess and the very end of the media would lie on the transport surface.

Figure 6:
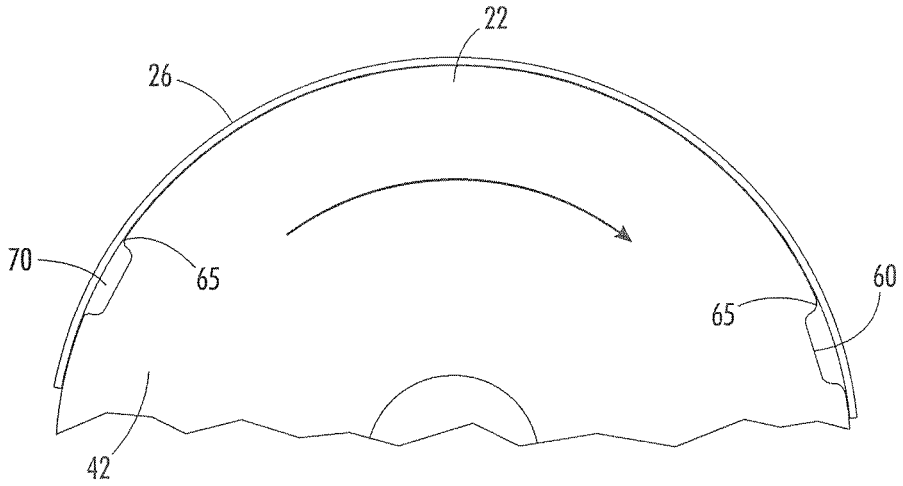
FIG. 6 is a side view of a portion of a media transport vacuum drum showing a sheet of media extending past recesses on a media transport surface

In an alternative embodiment shown in FIG. 6, the first and second recesses, 60 and 70 respectively, may be located slightly back, approximately 2 to 10 mm, from the leading 50 and trailing 52 edges. Therefore, the distance between the first and second recesses is less than the length of the media 26. This provides the benefit of increasing the bending moment since the recess edge 65 forming the bend point or fulcrum is disposed back further from the edge of the sheet. In this way, the width of the recesses 60, 70 may be kept relatively small. In this embodiment, recess in the order of 50 to 75 microns deep may be desirable. The sheet deflection into the recess would near the sheet edges. This would help reduce any issues of compromised image quality.

Figure 1:
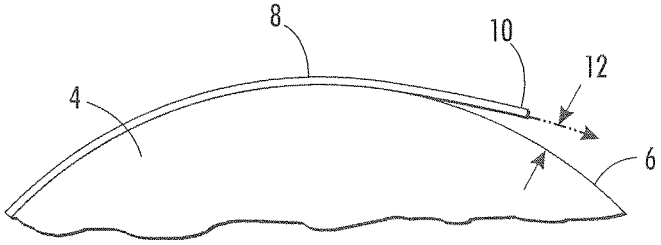
FIG. 1 PRIOR ART
FIG. 1 is a portion of a prior art vacuum drum with a sheet secured thereto.
Figure 7:
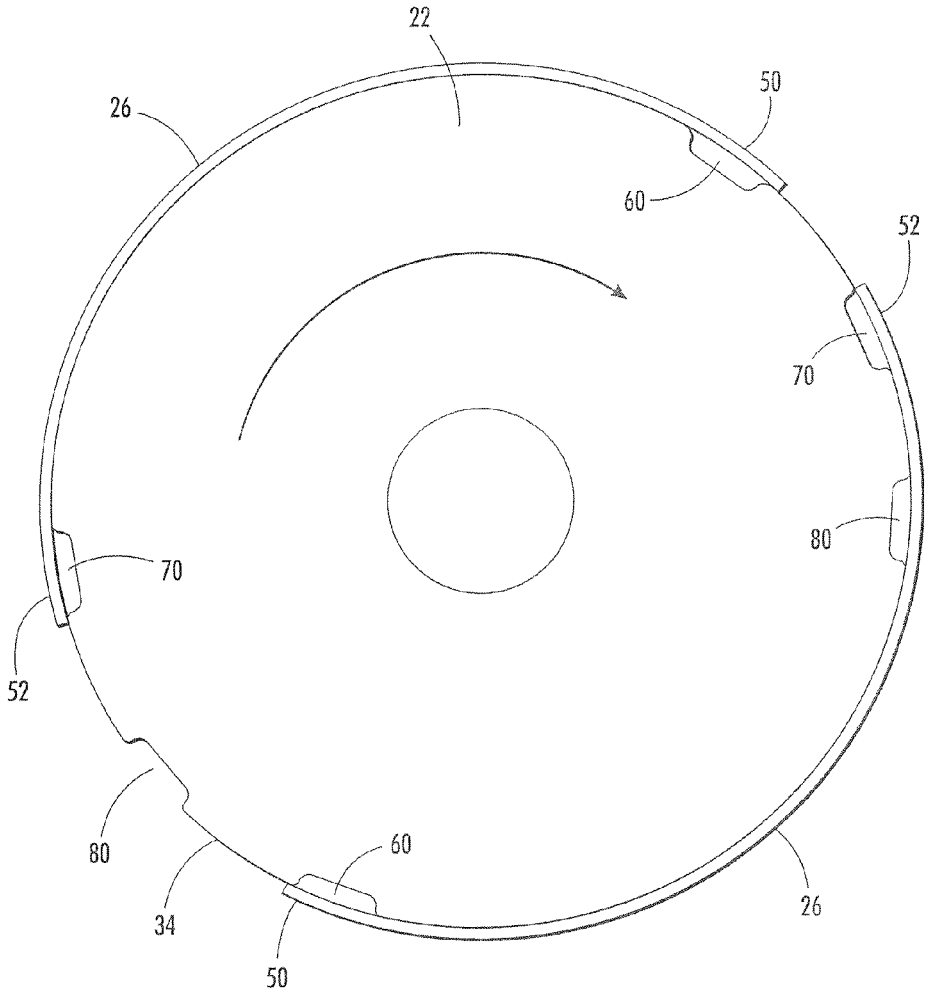
FIG. 7 is a side view of a media transport vacuum drum with multiple sets of recess to secure multiple sheets.

With reference to FIGS. 1, 5, and 7, it is also contemplated that additional recesses 80 may be formed in the transport surface 34, in order to accommodate sheets 26 having different lengths. The vacuum to the various recesses can be selectively turned on and off by the controller 46 (FIG. 1) such that only the recesses which are disposed adjacent to the leading and trailing edges of the substrate media are subjected to vacuum. Any recesses disposed beneath the media 26 that are not adjacent to the leading or trailing edges would have the vacuum turned off. This would help prevent distortions in the medial portions of the substrate media which could affect image quality. The controller 46 may be operably connected to a media length input 82 so that the controller may apply vacuum to the recess responsive to the media length. The media length input may be a sensor disposed in the travel path of the substrate media or it may be an input selected by an operator.

Figure 7A:
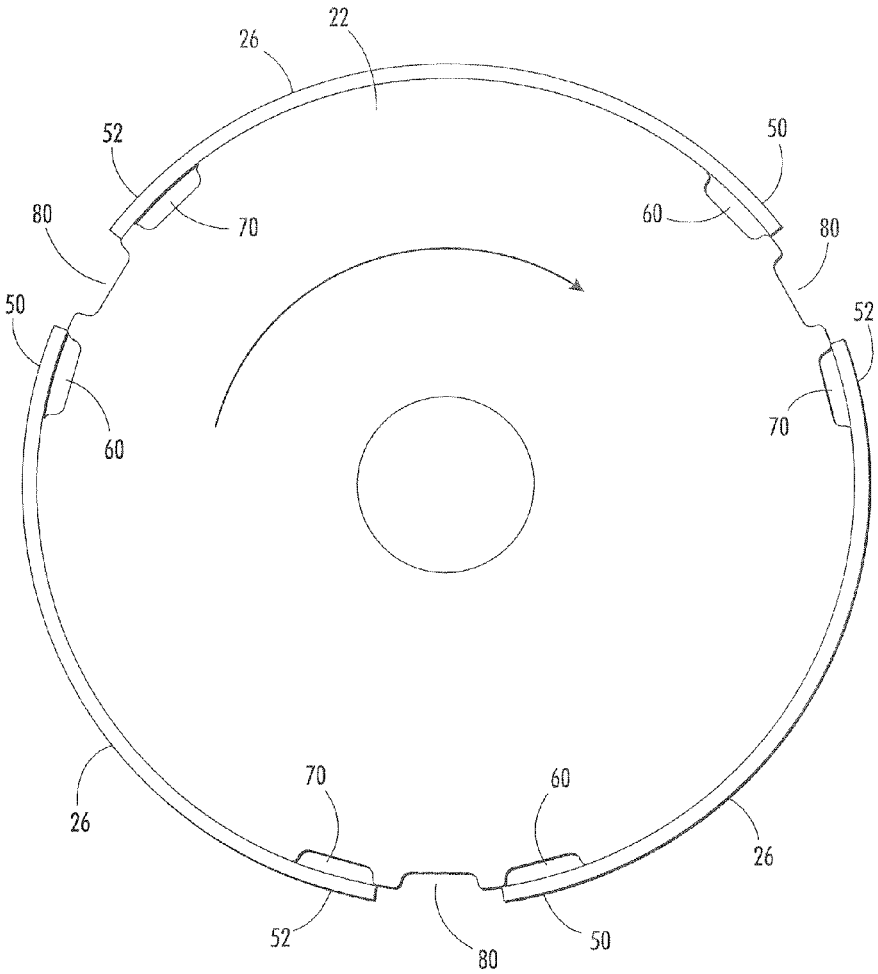
FIG. 7A is a side view of a media transport vacuum drum with multiple sets of recess to secure three sheets.

As shown in FIGS. 7 and 7A, multiple sets of recesses may be formed in the transport surface 34 in order to allow the media transport to carry a plurality of media sheets 26 at a time. For example, FIG. 7 shows two sheets 26 being transported and FIG. 7A shows three sheets being transported. It is also contemplated that a media transport could be configured with multiple sets of recesses to secure more than three sheets. Sheets 26 may be transported with a recess 60 and 70 being disposed adjacent the leading 50 and trailing 52 edges for each sheet. In order to permit multiple sheets of different lengths to be accommodated, additional recess 80 may be formed on the transport surface 34. As set forth above, the recesses not located near the edge of given size media could optionally have their vacuum turned off by the controller 46 to minimize any deflection of the mid span of the sheets. With no vacuum in a "center span slot" and slot widths of an inch or less, the sheets spanning the slot will roughly follow the curvature of the drum.

Figure 8:
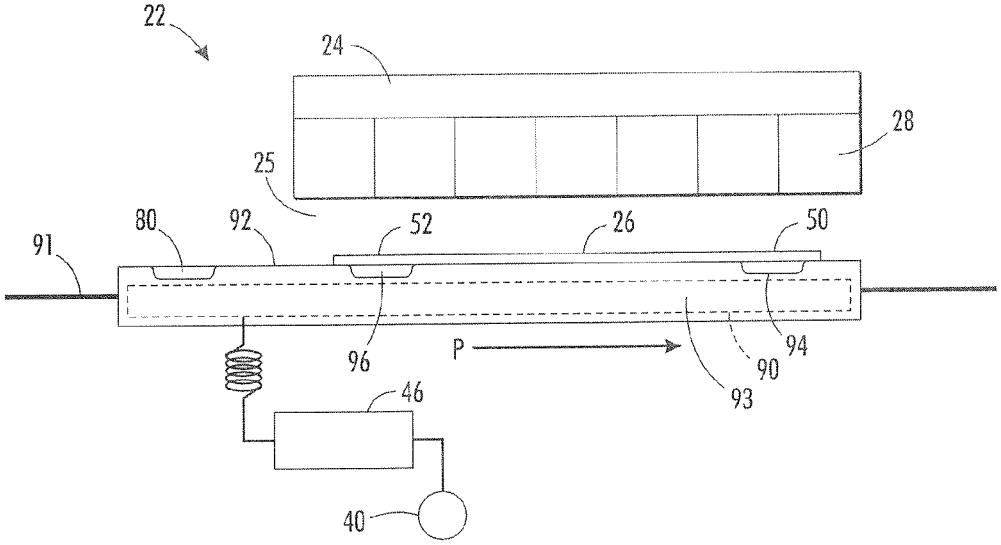
FIG. 8 is a side view of a media transport sled with a sheet thereon.
Figure 9:
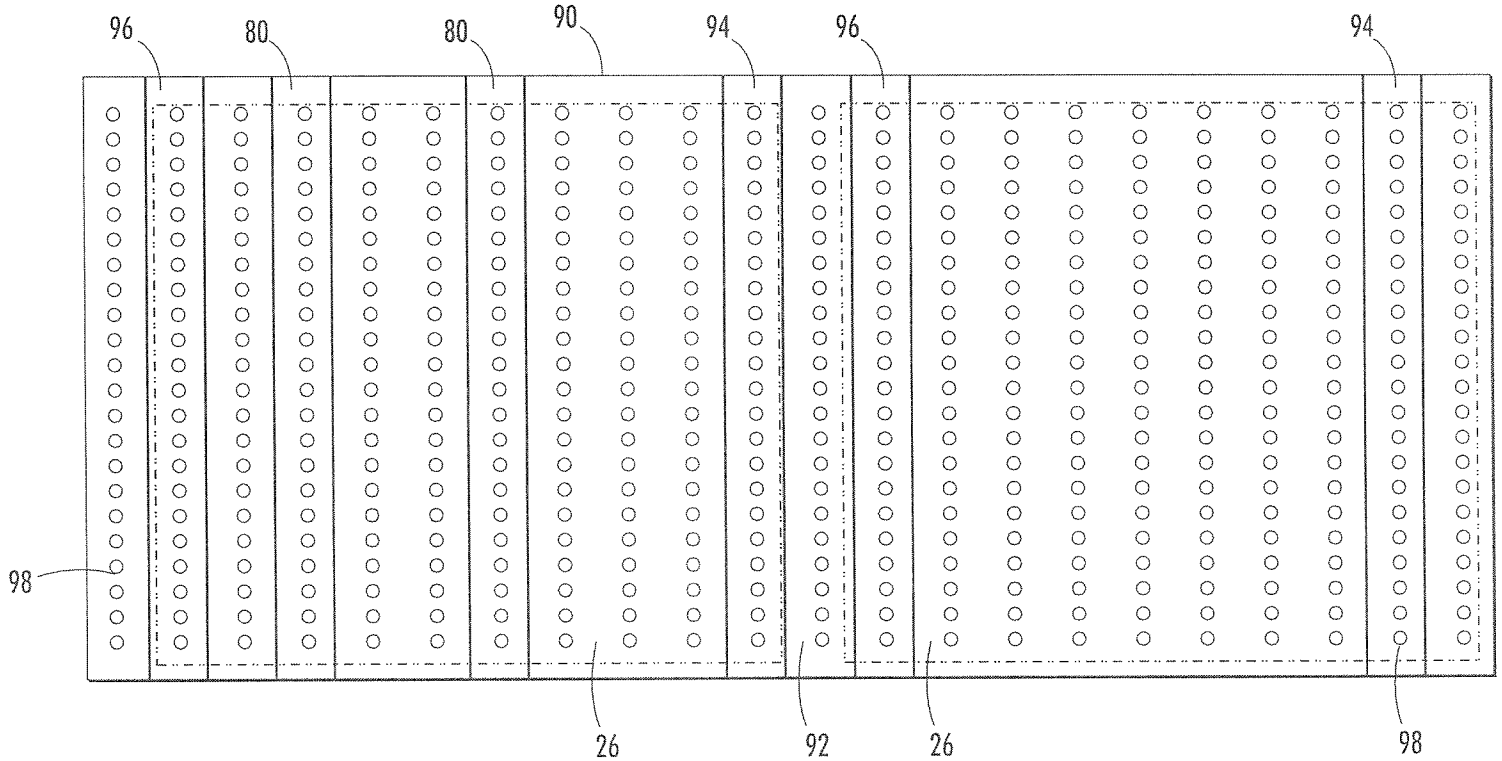
FIG. 9 is a top view of the media transport sled of FIG. 8.

In an alternative embodiment shown in FIGS. 8 and 9, the media transport may be in the form of a sled 90 having a generally planar transport surface 92. The sled 90 may be translated back and forth in the process direction P. The sled carries one or more sheets 26 through the print zone 25 and under the print heads 28 for receiving an image. The sled 90 may be transported on a linear guide 91 in a manner known in the art. The transport surface 92 may include a first and second recess 94 and 96 generally aligned with the leading 50 and trailing 52 edges of the media. The recesses may be formed in a manner similar to the recesses described above in the drum embodiment. Additional recesses 80 may be formed therein in order to accommodate sheets at different lengths and/or multiple sheets. For example, the sled 90 of FIG. 9 is shown carrying 2 sheets 26. The transport surface 92 may include a plurality of vacuum openings 98 which are in fluid communication with a vacuum source 40. The sled 90 may include a generally hollow vacuum plenum 93 connected to the vacuum source 40. The plenum 93 communicates with the surface vacuum openings 98 may be arranged such that various sections of transport surface 34 may be selectively and independently subjected to a vacuum. The controller 46 may selectively control the application of vacuum to various recesses 96, 94 and 80 of the transport surface as desired. Accordingly, certain recesses of the transport surface may be subjected to vacuum while others may not.

With reference to FIGS. 1 and 5, operation of the media transport will now be described. The media transport may energize a set of transport rollers 30 which drive a sheet of media 26 in the process direction P and deliver the sheet to the media transport 22. The media transport 22 includes a transport surface 34 having a plurality of vacuum openings 38 formed therein in fluid communication with a vacuum source 40. The sheet of media 26 is positioned on the transport surface 34 such that the media leading edge 50 is at least partially disposed over the first recess 60. Vacuum is applied through the transport surface to draw the sheet of media toward the transport surface. The media transport 22 moves the substrate media in the process direction past a print zone 25. In the embodiment wherein the media transport is a drum 42, the drum rotates the media past the print zone 25. In the embodiment shown in FIGS. 8 and 9 wherein the media transport is in the form of a sled 90, the sled translates the media past the print zone 25. After the image has been imparted on the media 26, the media is released from the media transport surface 34. The media may be released by terminating the vacuum and exposing the vacuum openings 38 to atmosphere. Alternatively, the controller 46 could cause a positive pressure to be applied to help separate the media 26 from the transport surface 34. The media transport may keep cycling by repeatedly picking out sheets of media and securing the sheet to the transport surface, moving them past the print zone, and releasing the sheets in order to move media through the printing system 20.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media hold down apparatus comprising:

a media transport including an transport surface having a plurality of vacuum openings formed therein in fluid communication with a vacuum source, the media transport adapted to move substrate media in a process direction past a print zone; and the transport surface including a first recess extending in a cross-process direction along a portion of a width of a first sheet of substrate media transport, the recess being disposed on the media transport such that the recess lies beneath a leading edge portion of the first sheet of substrate media, the recess being in communication with the vacuum source, wherein the vacuum urges the leading edge portion toward the recess on to the transport surface, and wherein the recess includes a bottom wall and a first and a second wall extending from the bottom wall to the transport surface.

2. The apparatus as defined in claim 1, wherein the recess extends in the cross-process direction an amount equal to or greater than a width of the substrate media.

3. The apparatus as defined in claim 1, wherein the media transport is a drum having a curved transport surface for supporting the substrate media thereon.

4. The apparatus as defined in claim 1, wherein the media transport is a sled having a generally planar transport surface for supporting the substrate media thereon.

5. The apparatus as defined in claim 1, wherein the recess includes an edge forming a fulcrum upon which the substrate media bends toward the transport surface upon operation of the vacuum.

6. The apparatus as defined in claim 1, wherein at least one of the first and second walls forms an obtuse angle with the bottom wall and slopes toward the transport surface.

7. The apparatus as defined in claim 1, wherein the transport surface includes a second recess extending in a cross-process direction along a portion of a width of the media transport, the second recess being disposed on the media transport such that it lies beneath a trailing edge portion of the first sheet of substrate media.

8. The apparatus as defined in claim 7, wherein the transport surface includes a third recess formed therein extending in a cross-process direction along a portion of a width of the media transport, the third recess being disposed on the media transport such that it lies beneath a leading or trailing edge portion of a second sheet of substrate media.

9. The apparatus as defined in claim 8, wherein the transport surface includes a fourth recess formed therein extending in a cross-process direction along a portion of a width of the media transport, the third recess and fourth recess cooperating to secure the leading and trailing edge portions of the second sheet of substrate media.

10. The apparatus as defined in claim 1, wherein the transport surface includes a plurality of recesses formed therein extending in a cross-process direction along a portion of a width of the media transport, the plurality of recesses cooperating to secure the leading or a trailing substrate edged of sheet transported thereon.

11. The apparatus as defined in claim 1, wherein the transport surface includes more than four recesses formed therein extending in a cross-process direction along a portion of a width of the media transport, the more than four recesses cooperating to secure substrate edges of one of a third or more sheets of substrate media and sheets of alternate lengths.

12. A direct marking system comprising:

a media transport including a transport surface having a plurality of openings formed therein in fluid communication with a vacuum source to constrain media through the application of a vacuum force, the outer surface including a first recess extending in a cross-process direction along a portion of a width of the media transport, the first recess being disposed on the media transport such that it lies beneath a leading edge portion of the media, the first recess being in communication with the vacuum source, wherein the leading edge portion of the media is pulled down by the vacuum toward the first recess on to the transport surface, and the media transport including a second recess spaced from the first recess, the second recess being disposed on the media transport such that it lies beneath a trailing edge portion of the media; and an image marking system for marking the media when passing through a print zone, wherein the media transport moves the media in a process direction past the image marking system.

13. The system as defined in claim 12, wherein a plurality of recesses are positioned on the transport surface corresponding to a range of media sizes.

14. The apparatus as defined in claim 12, wherein the media transport is one of a drum having a curved outer surface for supporting the substrate media or a sled having a generally planar surface.

15. The system as defined in claim 12, wherein the first and second recesses are generally in the range of 50 and 200 microns in depth and have a width generally in the range of 10 to 50 mm.

16. The system as defined in claim 12, wherein a distance between the first recess and the second recess is less than a length of the media wherein the leading edge and trailing edges extend past the first and second recesses.

17. A media hold down apparatus comprising:

a media transport including an transport surface having a plurality of vacuum openings formed therein in fluid communication with a vacuum source, the media transport adapted to move substrate media in a process direction past a print zone; and the transport surface including a first recess extending in a cross-process direction along a portion of a width of a sheet of substrate media transport, the first recess being disposed on the media transport such that the first recess lies beneath a leading edge portion of the first sheet of substrate media, the first recess being in communication with the vacuum source, wherein the vacuum urges the leading edge portion toward the first recess on to the transport surface, and wherein the transport surface includes a second recess extending in a cross-process direction along a portion of a width of the media transport, the second recess being disposed on the media transport such that it lies beneath a trailing edge portion of the sheet of substrate media.

18. A media hold down apparatus comprising:

a media transport including an transport surface having a plurality of vacuum openings formed therein in fluid communication with a vacuum source, the media transport being a sled having a generally planar transport surface for supporting the substrate media thereon, the media transport being adapted to move substrate media in a process direction past a print zone; and the transport surface including a first recess extending in a cross-process direction along a portion of a width of a first sheet of substrate media transport, the recess being disposed on the media transport such that the recess lies beneath a leading edge portion of the first sheet of substrate media, the recess being in communication with the vacuum source, wherein the vacuum urges the leading edge portion toward the recess on to the transport surface.

* * * * *